US006845567B1

(12) United States Patent
Muncy

(10) Patent No.: US 6,845,567 B1
(45) Date of Patent: Jan. 25, 2005

(54) APPARATUS FOR GUN SCOPE ADJUSTMENT

(76) Inventor: Larry Muncy, 17595 Beach La., Lake Milton, OH (US) 44429

( * ) Notice: Subject to any disclaimer, the term of this patent is extended or adjusted under 35 U.S.C. 154(b) by 0 days.

(21) Appl. No.: 10/425,071

(22) Filed: Apr. 28, 2003

Related U.S. Application Data

(60) Provisional application No. 60/377,499, filed on May 1, 2002.

(51) Int. Cl.[7] ..... G01B 3/02; F41G 1/54

(52) U.S. Cl. ..... 33/506; 33/494

(58) Field of Search ..... 33/506, 494, 492, 33/483, 491, 484, 679.1, 562, 563, 566; D10/71; 434/17, 19, 23, 195

(56) References Cited

U.S. PATENT DOCUMENTS

| | | | | | |
|---|---|---|---|---|---|
| 569,358 | A | * | 10/1896 | Sommerfeldt | 33/491 |
| 2,264,296 | A | * | 12/1941 | Clark | 33/506 |
| 2,417,451 | A | * | 3/1947 | Schaffner | 273/409 |
| 2,521,087 | A | * | 9/1950 | Paulus | 33/506 |
| 4,132,000 | A | * | 1/1979 | Dulude | 33/562 |
| 4,244,586 | A | * | 1/1981 | Gorrow | 273/409 |
| 4,329,570 | A | | 5/1982 | Koll | 273/78 R |
| 4,484,395 | A | * | 11/1984 | Samuels | 33/494 |
| 5,031,920 | A | | 7/1991 | Poirier | 273/371 |
| 5,181,719 | A | | 1/1993 | Cleveland, III | 273/409 |
| 5,822,875 | A | * | 10/1998 | Feldner | 33/494 |
| 5,881,469 | A | * | 3/1999 | Monck | 33/494 |
| 5,960,576 | A | * | 10/1999 | Robinson | 42/90 |
| 6,196,455 | B1 | * | 3/2001 | Robinson | 235/70 A |

* cited by examiner

*Primary Examiner*—Diego Gutierrez
*Assistant Examiner*—R. Alexander Smith
(74) *Attorney, Agent, or Firm*—Harpman & Harpman

(57) ABSTRACT

A method and apparatus for improving the accuracy of a telescopic sight used on a projectile weapon. The method allows an individual to effectively and efficiently "sight in" their firearm sight based on performance shot pattern in a target at pre-determined range values. The method utilizes a series of static gauges that represent uniform incremental indicia thereon that correspond to telescopic sight range adjustment input values. The gauges are placed on the target to indicate the required adjustment to be made to achieve an accurate shot performance at a given distance.

9 Claims, 5 Drawing Sheets

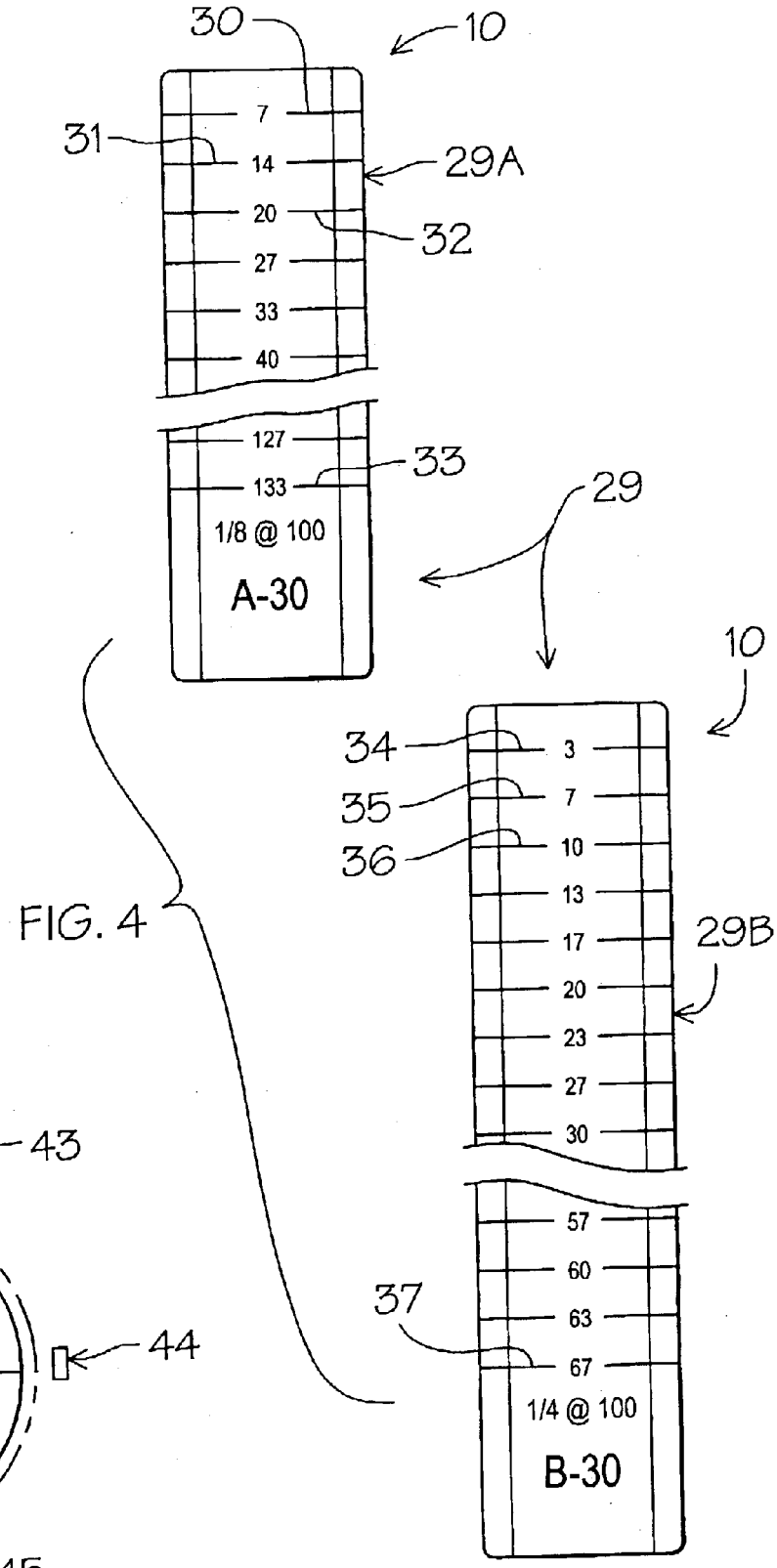
FIG. 4
FIG. 9
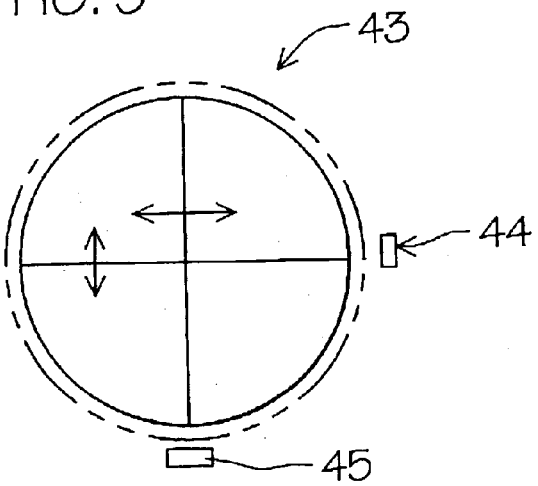

APPARATUS FOR GUN SCOPE ADJUSTMENT

This application claims the benefit of Provisional application Ser. No. 60/377,499, filed May 1, 2002.

BACKGROUND OF THE INVENTION

1. Technical Field

This device relates to target shooting and/or hunting in which a firearm must be "sighted in" with respect to the telescopic site used therewith.

2. Description of Prior Art

Prior art devices of this type are directed towards the proper adjustment of gun sites on a firearm in relation to actual performance. It is well understood within the art that gun sites must be adjusted for accuracy depending on the range of the target and orientation of the site on a firearm. Accordingly, so called "sighting in" of the firearm to the target is an important step that is done before competitive shooting, for example, can take place. Such prior art devices have used a variety of different systems and apparatus to achieve same, see for example U.S. Pat. Nos. 4,329,570, 5,031,920, 5,181,719 and 6,196,455.

In U.S. Pat. No. 4,329,570 a lead calculator is disclosed in which the logarithmic scales with indicia corresponding to the parameters of target speed and projectile speed and lead are displayed on a series of concentric wheels so as to compare to one another to provide information related thereto.

U.S. Pat. No. 5,031,920 discloses a shot pattern checker device that uses a transmitted image of a target to a central processing unit that displays the target on a video screen with superimposed grid and calculating lines thereon. Shot patterns so generated can therefore be analyzed by electronic manipulation of the gauge display which can assure assist in determining the accuracy of the shot pattern and steps required to adjust the sites in response to it.

U.S. Pat. No. 5,181,719 claims a target kit for improving the ease and accuracy of citing a telescopic site on a firearm. The kit uses a pre-printed a target sheet positioned on a stand for allow for visual interpretation of the shot pattern and related adjustment of the site.

U.S. Pat. No. 6,196,455 is directed to a range and drop calculator for sighting in telescopic gun sights. A hand held calculating apparatus has various longitudinal scales on two members. By manipulating the movable ruler elements to align certain selected markers, a determination of range can be derived so as to indexing and align by adjustment the gun sight.

SUMMARY OF THE INVENTION

A gun scope adjustment gauge set to provide target shot placement analysis for determining the required mechanical adjustment to be made to the gun sight at a given distance depending on the relative shot performance pattern on the target. Each gauge is for a specific distance with corresponding indicia to indicate adjustment input to the sight depending on the physical placement on the target and positioning of the shot pattern in relation thereto.

DESCRIPTION OF THE DRAWINGS

FIG. 4 is a front elevational view of an alternate range adjustment gauge set with portions broken away;

FIG. 9 is a graphic representation of the ratio adjustment of the gun scope of the invention.

DESCRIPTION OF THE PREFERRED EMBODIMENT

Figure 1:
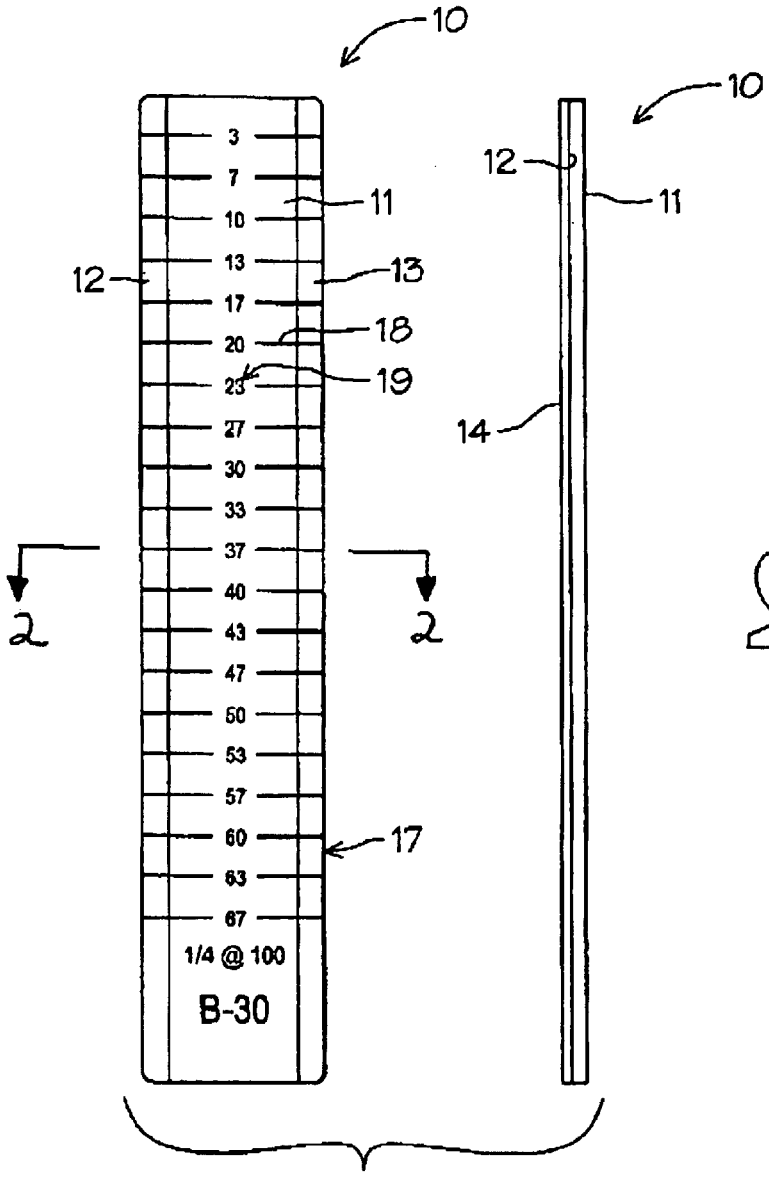
FIG. 1 is a front and side elevational view of a gun scope gauge of the invention.
Figure 2:
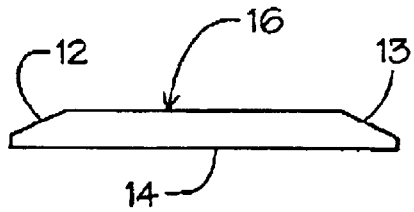
FIG. 2 is an end view on lines 2—2 of FIG. 1.

Referring to FIGS. 1 and 2 of the drawings, a target gauge 10 of the method can be seen having elongated rectangular body member 11 of translucent rigid material. The body member 11 is preferably made of synthetic resin material with, in this example, oppositely disposed elongated tapered perimeter edge surface portions 12 and 13 as best seen in FIG. 2 of the drawings. The target gauge 10 has a flat bottom surface 14 for positioning on a target 15 as will be described in greater detail hereinafter and an oppositely disposed upper viewable surface 16 on which the respective perimeter tapered edge surfaces 12 and 13 are formed.

Multiple target gun scope gauge sets 17 are required to correspond to multiple yardage use groups specifically twenty-five yards, thirty yards, fifty yards and one-hundred yards to the target 15. Each of the yardage gauge group requires two gun scope gauges 10 for the gun scope adjustments specifically numerically ⅛ inch adjustment at one hundred yards and a numerical ¼ inch adjustment at one hundred yards scope adjustment ratios for example. Each of the multiple gun scope gauge sets 17 have a plurality of longitudinally spaced incremental adjustment line indicia 18 thereon and corresponding numbered indicia 19.

Figure 3:
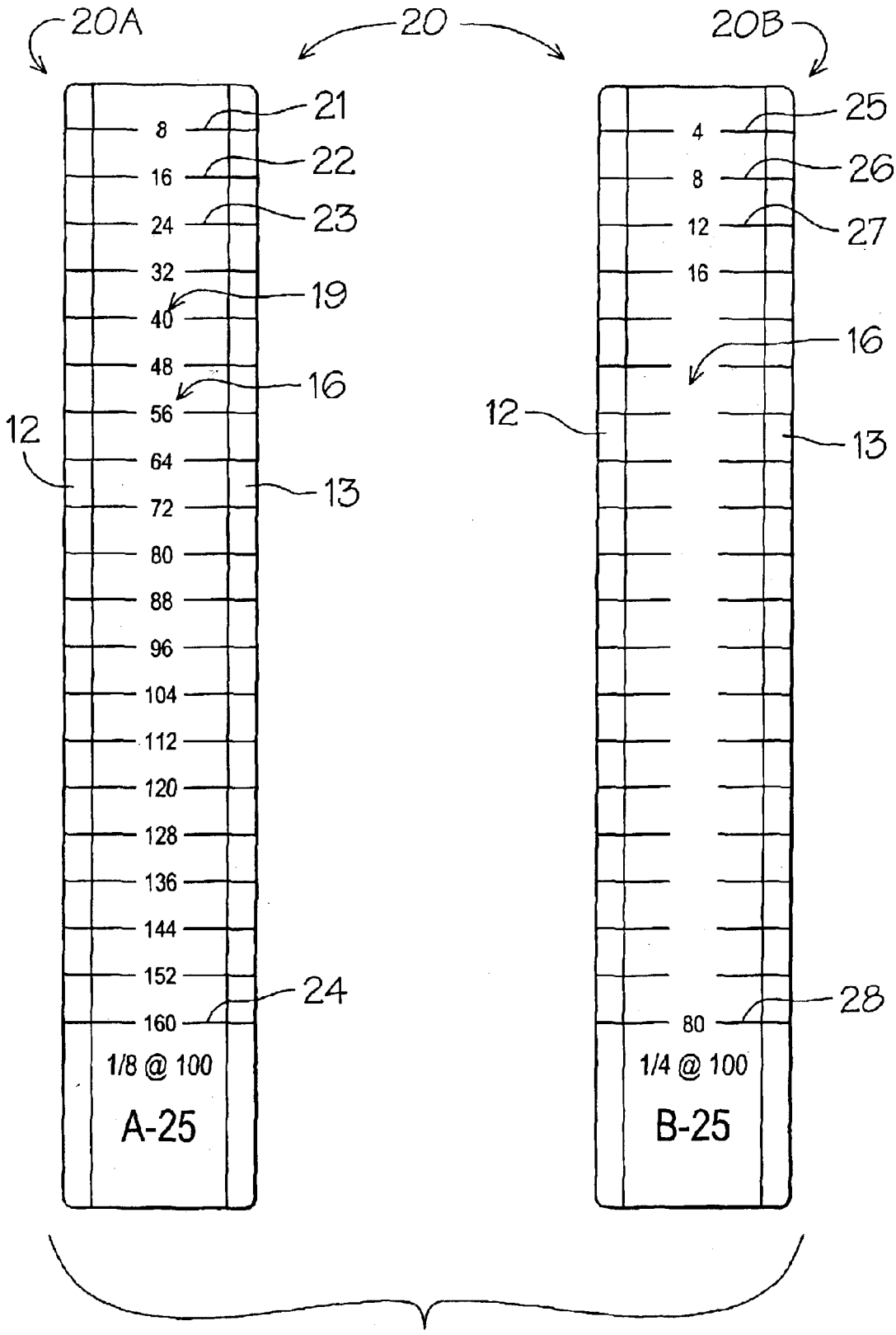
FIG. 3 is a front elevational view of a gun scope sight for a specific twenty-five yard range.

Referring now to FIG. 3 of the drawings, a gun scope gauge set 20 for twenty-five yards can be seen having a ⅛ inch adjustment at one-hundred yards gauge 20A and ¼ adjustment at one-hundred yards gauge 20B. The gun scope gauge 20A has twenty incremental adjustment line indicia beginning at 21 with numeral eight. The numeric values progressively increase to sixteen at 22, twenty-four at 23, and so on terminating at one-hundred and sixty at 24. Correspondingly, the gun scope gauge 20B has a different numerical value series related to the ¼ inch at one-hundred yard adjustment beginning at the numeral four at 25, numeral eight at 26, numeral twelve at 27 and terminating at the numeral eighty at 28.

The ⅛ and ¼ scope adjustment refers to the gun scope calibrations in which the incremental adjustment inputs are made by so called "clicks" which allows for the scope adjustment on both horizontal and vertical access as is well know within the art. A second gun scope gauge set 29 for thirty yards to the target 15 is illustrated in FIG. 4 of the drawings with portions broken away having a ⅛ indicating adjustment gauge 29A and ¼ indicating adjustment gauge 29B. The gun scope gauge 29A has a numerical value starting with the numeral seven at 30, fourteen at 31, twenty at 32 and ending at one-hundred and thirty-three at 33. In corresponding gun scope gauge 29 for ¼ inch at one-hundred yards begins with incremental numerical values of three at 34, seven at 35, ten at 36 progressively increasing to a final numerical value of sixty-seven at 37.

Figure 5:
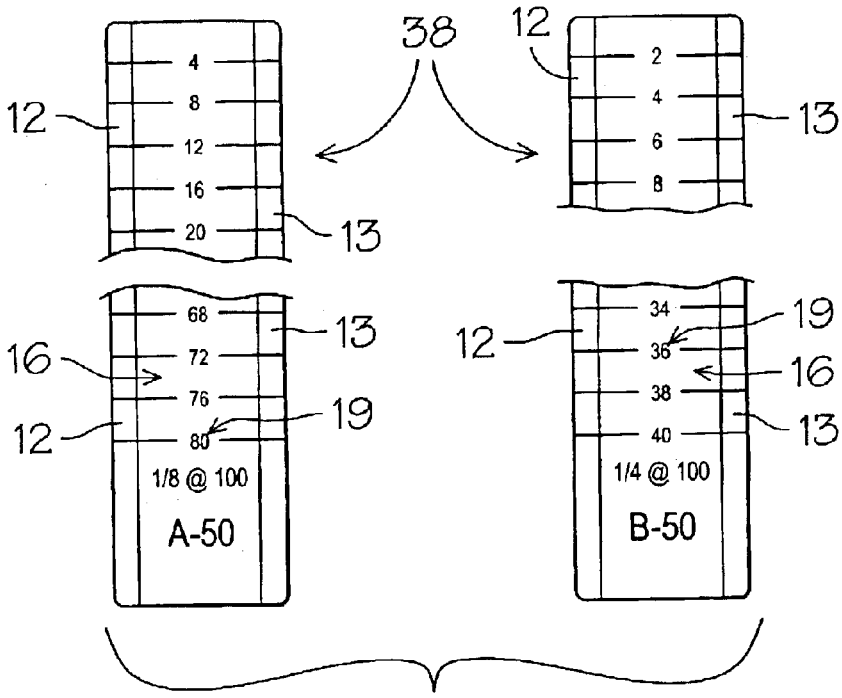
FIG. 5 is a partial front elevational view of an alternate range set of gun scope gauge of the invention.
Figure 6:
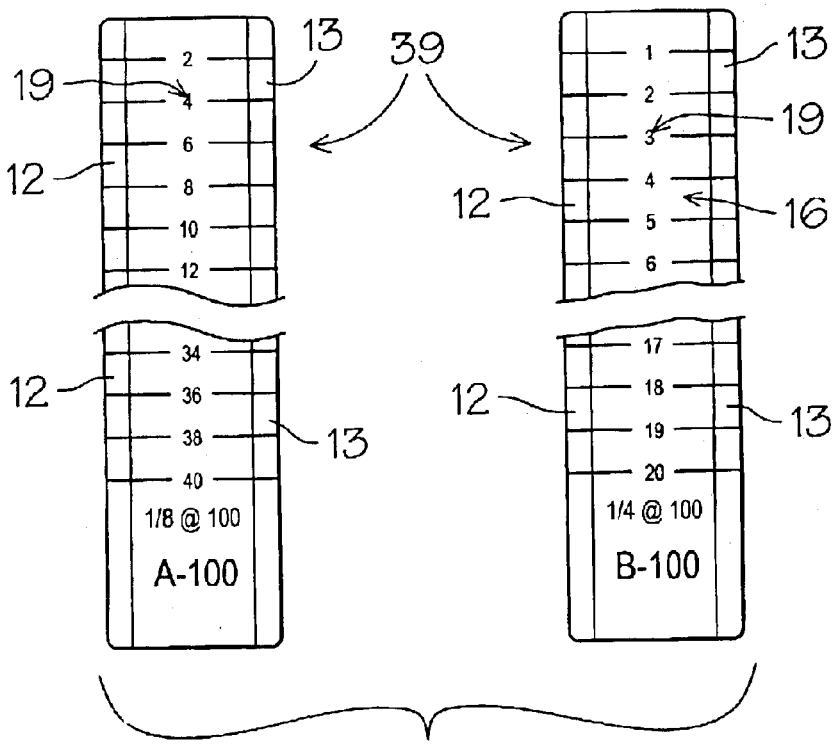
FIG. 6 is a partial front elevational view of an alternate range set of the invention.

The two remaining gun scope gauge sets 17 specifically gun scope set 38 for fifty yard range and gun scope set 39 for on-hundred yards can be seen in FIGS. 5 and 6 respectively of the drawings.

Figure 7:
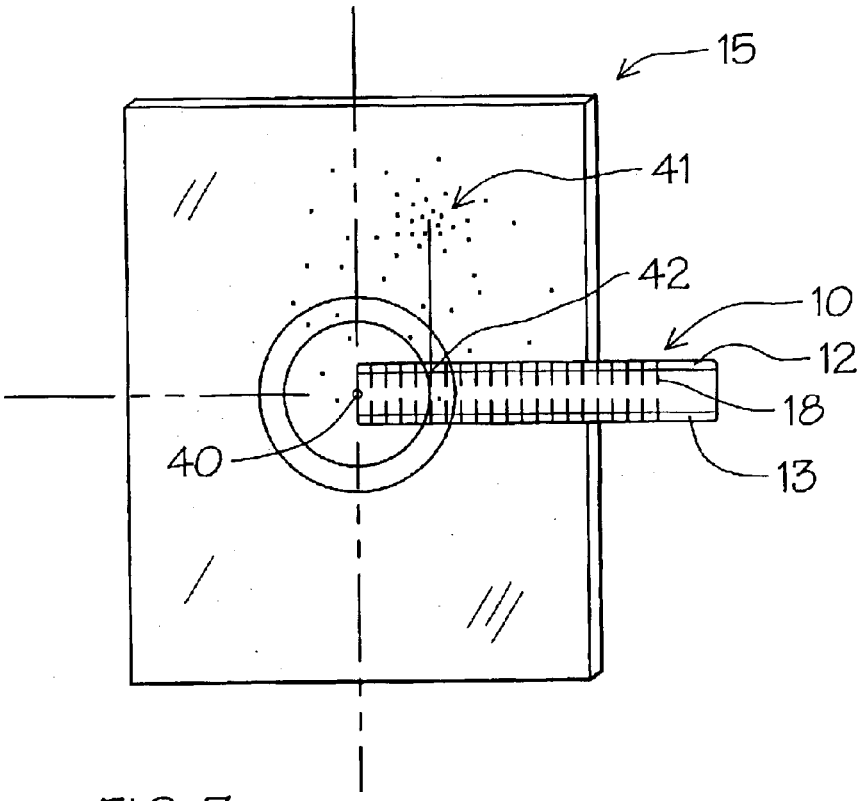
FIG. 7 is a graphic representation of a target with the gauge of the invention in use thereon.

In use, referring to FIG. 9 of the drawings, the ratio adjustment of the gun scope 43 must be determined, either ¼ at one-hundred yards or ⅛ at one-hundred yards which is common in the industry. Next the distance to the target 15 is determined with the selection of the appropriate gun scope gauge set 17 of the invention is then made dependent on the gun scope, and target ranges hereinbefore described. The user then shoots at the target with the firearm and then determines where the majority of the shots hit at 41 as seen in FIG. 7 of the drawings. The selected gun scope gauge 10 is placed on the target 15 by holding the gauge parallel flat against the surface of the target 15 with one end of the gauge at 10A at the target center 40 and then measures the distance to the majority of the shot determined by the user at 41 and reads the corresponding sight adjustment number at 42 on the gauge 10 that is best in line with the perceived shot concentration at 41. This number value 42 corresponds to the number of "click" adjustments input at 43 graphically represented in FIG. 8 of the drawings to be made on the gun scope to being the shot center 41 left or right which in this example is to the left.

Figure 8:
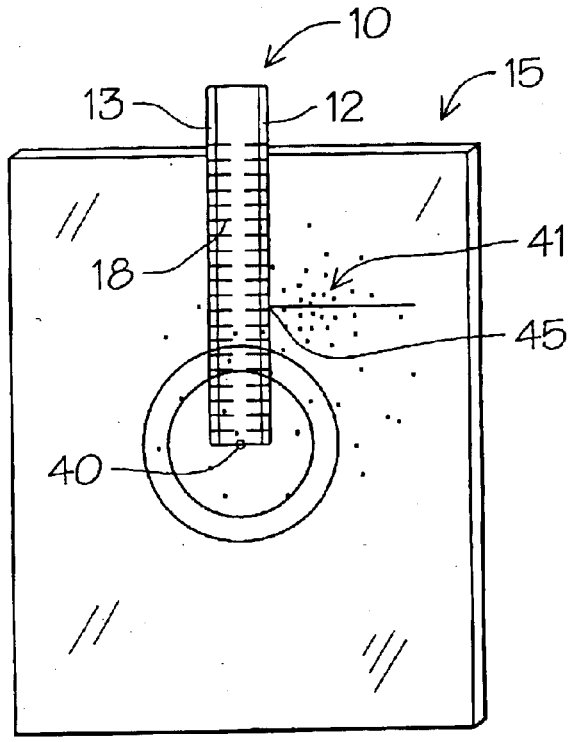
FIG. 8 is a graphic representation of a target with the gauge in use thereon.

The gun scope gauge 10 is then repositioned flat on the target 15 in vertical orientation with the gauge end 10A at the target center 40 and measuring to where the majority of the perceived shot 41 are and then reading the number that is best in line with the shot center 41. The number will correspond to the number of vertical scope "clicks" at 44 to be made thus adjusting the scope on its vertical axis as seen in FIG. 8 of the drawings.

It will be evident from the above referred to description that by utilization of the different gun scope gauge sets 17, the variety of target ranges can be effectively adjusted for in relation to the corresponding scope used on the firearm to properly sight in the firearm at the target distance desired.

It will thus be seen that a new and useful method and apparatus for firearm scope adjustment has been illustrated and described and it will be apparent to those skilled in the art that various changes and modifications may be made therein without departing from the spirit of the invention.

Therefore I claim:

1. An apparatus for determining gun scope adjustment input at varied target distance for a gun scope comprising, a set of gun scope adjustment gauges, each of said gauges having longitudinally spaced numerals and corresponding line indicia thereon, said numerical indicia are of progressively increasing numerical value to one another, said numerical values correspond to a number of adjustment clicks on said gun scope, said numerical indicia are of different progressive values on each of said gauges within said sets, said numerical and line indicia are evenly spaced on each of said gauges, means for selecting one of said gun scope adjustment gauges from said set to be used with a target, means for determining vertical and horizontal adjustment for said gun scope.

2. The apparatus for determining a gun scope adjustment input set forth in claim 1 wherein each of said set of gun scope adjustment gauges comprises, a pair of said gauges, each of a varied target distance.

3. The apparatus set forth in claim 2 wherein each of said gauges correspond to a specific gun scope adjustment value.

4. The apparatus set forth in claim 1 wherein said gun scope adjustment gauge is preferably made of transparent synthetic resin material.

5. The apparatus set forth in claim 1 wherein said gun scope adjustment gauge defines a rectangular body member.

6. The apparatus set forth in claim 5 wherein said rectangular body member has a flat target engagement surface and an oppositely disposed contoured upper surface.

7. A method of using the apparatus as set forth in claim 1 comprising, steps of, a. determining a distance to the target, b. determining an adjustment ratio of said gun scope, c. matching said gun scope adjustment gauge that corresponds to said gun scope adjustment and distance to target.

8. The method of using the apparatus as set forth in claim 7 further comprising, placing said selected gun scope adjustment gauge on said target on a horizontal plane extending from a center of said target, determining maximum shot impact area on said target, determining a corresponding numerical and line indicia to said shot impact area on said target, adjusting said gun scope by the number value determined on said gun scope adjustment gauge.

9. The method of using the apparatus as set forth in claim 8 further comprising, placing said selected gun scope adjustment gauge on said target on a vertical plane extending from a center of said target, determining maximum shot impact area on said target, determining a corresponding numerical and line indicia to said shot impact area on said target, adjusting said gun scope by the number value determined on said gauge.

* * * * *